United States Patent [19]

Shirosaka et al.

[11] Patent Number: 4,988,963

[45] Date of Patent: Jan. 29, 1991

[54] HIGH FREQUENCY COAXIAL LINE COUPLING DEVICE

[75] Inventors: Toshiaki Shirosaka, Toyono; Nobuyuki Ten, Takarazuka, both of Japan

[73] Assignee: DX Antenna Company, Limited, Hyogo, Japan

[21] Appl. No.: 461,755

[22] Filed: Jan. 8, 1990

[30] Foreign Application Priority Data

Feb. 23, 1989 [JP] Japan ..... 1-44841
Jul. 7, 1989 [JP] Japan ..... 1-176104

[51] Int. Cl.[5] ..... H01P 1/06

[52] U.S. Cl. ..... 333/261; 439/21; 439/578

[58] Field of Search ..... 333/256, 257, 261; 343/763; 439/20, 21, 578

[56] References Cited

U.S. PATENT DOCUMENTS 3,786,376 1/1974 Manson et al. ..... 333/261
4,741,702 5/1988 Yasumoto ..... 439/578 X

FOREIGN PATENT DOCUMENTS 781672 8/1957 United Kingdom ..... 333/21 R

*Primary Examiner*—Paul Gensler
*Attorney, Agent, or Firm*—Morris Fidelman; Franklin D. Wolffe

[57] ABSTRACT

A high frequency coaxial line coupling device which is insertable along the length of a coaxial line such as that which connects a rotary antenna carried on a moving body such as vehicle or vessel to receive a signal from a communication or broadcast satellite, with a receiver component such as tuner fixed to the moving body, for the purpose of allowing free relative rotation of the two segments of the coaxial line separated by the coupling device and preventing twist or entanglement of the coaxial line caused by rotation of the antenna with turning movement of the moving body. The device structure provides for a low transmission loss characteristic over a wide frequency range.

5 Claims, 5 Drawing Sheets

HIGH FREQUENCY COAXIAL LINE COUPLING DEVICE

BACKGROUND OF INVENTION

This invention relates to a device for coupling a co-axial line used for transmitting a high frequency signal to another coaxial line and, especially, to a coupling device which enables relative rotation of both coaxial lines about their longitudinal axis without mutual entanglement.

For receiving satellite communication or satellite broadcast on a moving body such as vehicle or vessel, it is necessary to carry a microstrip or parabolic receiving antenna on the moving body and to direct it always to the satellite. Accordingly, the receiving antenna rotates with respect to the moving body with turning movement of the moving body and this may result in twist and entanglement of a coaxial cable connecting a convertor fixed to the antenna with a tuner fixed to the moving body. If the co-axial cable is elongated in order to suppress such twist and entanglement, it may wind round an antenna driving device and its attachments. It has been a general practice for avoiding this problem to cut the coaxial cable into two segments and insert a rotary joint therebetween.

The most primitive one of the rotary joints, as shown in the Japanese patent opening gazette No. 60169902, includes a pair of shells which are coupled to enable relative rotation along with their mutual contact and also electrically connected to the braids of outer conductors of two coaxial cables, respectively, a male pin which is insulatedly fixed to one of the shells and electrically connected to the central conductor or core of one of the coaxial cables, and a female pin which is insulatedly fixed to the outer shell and electrically connected to the central conductor or core of the other coaxial cable, and the male pin is inserted in the female pin so that they can relatively rotate in this state together with the shells. In such a coupling, however, the contact between the male and female pins is incomplete and a stray capacitance is formed therebetween. This stray capacitance, together with the contact resistance, varies with rotation and results in variable loses at the junction. Use of a spring or the like for improving the contact complicates the structure, and the mechanical contact lacks durability due to abrasion.

It has been proposed to capacitively couple both central conductors without the mechanical contact which is the cause of the above mentioned problems. In this case, circular discs are fixed normally to the tops of both central conductors and both discs are spaced at a fixed interval to form a capacitor. If the diameter of the discs is 10 mm and the interval is 1 mm, for example, the capacitance of this capacitor is about 1.5 pF. In case of transmitting a signal having a frequency of about 1 GHz, however, this results in a large impedance and reduced transmission loss characteristic as shown by curve A in FIG. 1. If a lumped constant coil 8 is inserted between each central conductor 2 and disc 6 as shown in FIG. 2 in order to cancel the capacitance between both discs, a stray capacitance is induced between the coil 8 and the shell 4 connected to the outer conductor as shown in phantom and the transmission loss characteristic is substantially improved as shown by curve B in FIG. 1. However, removal of discs 6 also has been considered, it would reduce excessively the distribution capacitance formed between both lumped constant coils 8, resulting, therefore, high Q which significantly reduces the bandwidth having low transmission loss as shown by curve C in FIG. 1.

Accordingly, an object of this invention is to provide a rotatable high frequency coaxial line coupling device which exhibits a low transmission loss over a relatively wide bandwidth.

SUMMARY OF INVENTION

The above object is attained by a high frequency coaxial line coupling device provided in accordance with this invention. The device comprises a pair of coaxial lines each having a signal line and reference potential means which surrounds each signal line, and the signal line is provided with a spiral electrode element having its central end connected to the end of the signal line and spreading in a plane normal to the signal line. The two electrode elements are adapted to be rotatable about a common axis of both coaxial lines, mutually facing, and concentrically spaced apart a predetermined interval, with their spirals being opposite in direction as viewed along either signal line.

These and other objects and features of this invention will be described in more detail below with reference to the accompanying drawings.

BRIEF DESCRIPTION OF DRAWINGS

In the drawings.

Throughout the drawings, same reference numerals are given to corresponding structural components.

DESCRIPTION OF PREFERRED EMBODIMENTS

Figure 1:
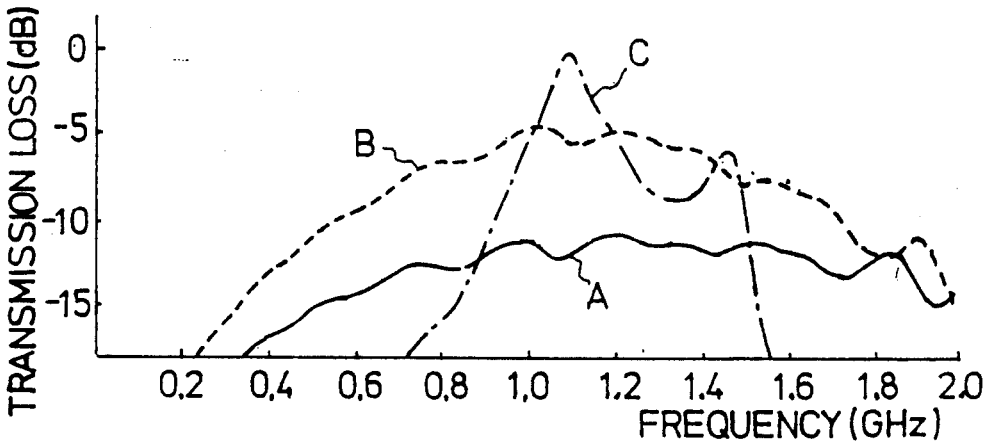
FIG. 1 (PRIOR ART)
FIG. 1 is a diagram representing frequency characteristics of transmission loss of prior art devices.
Figure 2:
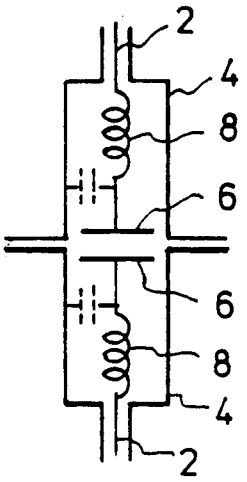
FIG. 2 (PRIOR ART)
FIG. 2 is a diagram representing an equivalent circuit of a prior art device.
Figure 3:
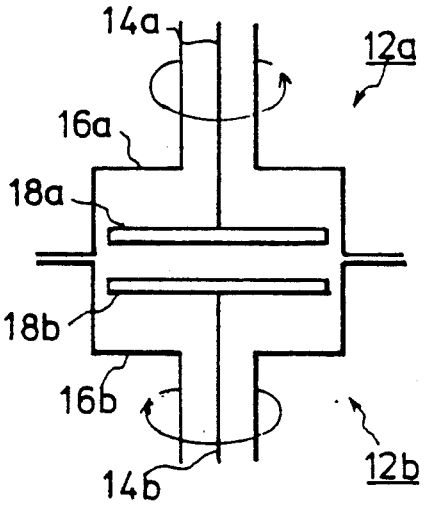
FIG. 3 is a schematic diagram representing a structure of the device according to this invention.
Figure 4:
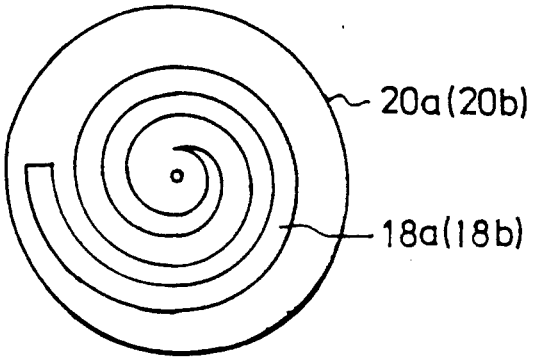
FIG. 4 is a plan view representing a rotary electrode surface of the device according to this invention.

In FIG. 3, coaxial paths 12*a* and 12*b* have signal lines 14*a* and 14*b* and outer reference potential portions 16*a* and 16*b* having the signal lines 14*a* and 14*b* as their axes, respectively, and these components constitute socalled coaxial lines together with dielectric (not shown) filled therebetween. Both signal lines 14a and 14b are respectively provided at their top with inductance elements 18a and 18b formed on respective planes normal to the axis. The inductance elements 18a and 18b are composed of spiral conductors formed, for example, by etching on circular printed boards 20a and 20b, as shown in FIG. 4, and connected to the signal lines 14a and 14b, respectively, at their central portions. Both inductance elements 18a and 18b are the same in winding direction of the spiral. Both coaxial paths 12a and 12b are arranged so as to have a common longitudinal axis, to face both inductance elements 18a and 18b at a predetermined interval and to put the outer reference potential portions 16a and 16b in mutual contact, and also coupled with each other by suitable means so as to be rotatable in mutually opposite direction as shown by arrows in FIG. 3.

Figure 5A:
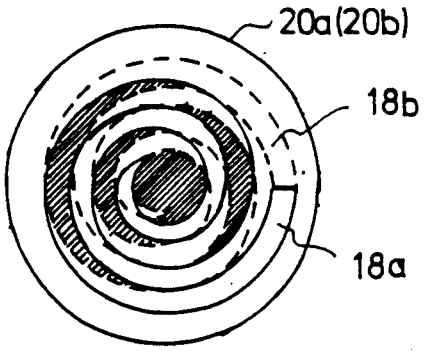
FIGS. 5A and 5B are diagrams illustrative of states of superposition of the rotary electrodes of the device according to this invention at two positions of relative rotation.
Figure 5B:
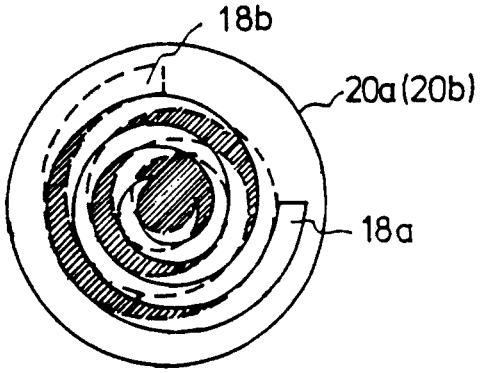
Figure 6:
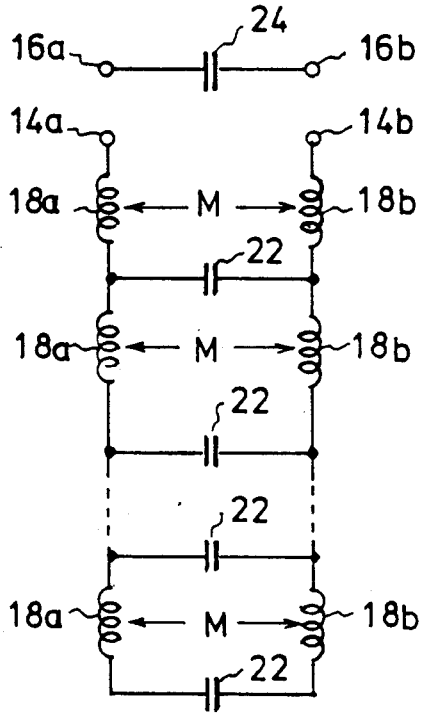
FIG. 6 is a diagram representing an equivalent circuit of the device according to this invention.

As shadowed in FIGS. 5A and 5B, both facing inductance elements 18a and 18b are partially superposed to form distribution capacitances 22 of FIG. 6. Electrical coupling is provided by the distribution capacitances 22 and the mutual inductive couplings M appearing between inductive elements 18a and 18b. The outer reference potential portions 16a and 16b are coupled through a stray capacitance 24 appearing therebetween, thereby forming a kind of band-pass filter. The equivalent circuit of FIG. 6 is a distributed constant circuit of open end and the impedance between the central portions of the spiral inductance elements 18a and 18b is expressed by the following equation.

$$Z = j \cot \beta l$$

where l is the length of the line and $\beta$ is a phase constant which is equal to $2\pi/\lambda$ ($\lambda$ is the wavelength). It is understood from this equation that $Z=0$ when the length of the spiral coil is $\lambda/4$. Then, no loss appears between the lines and the circuit functions as a repeater.

Figure 7:
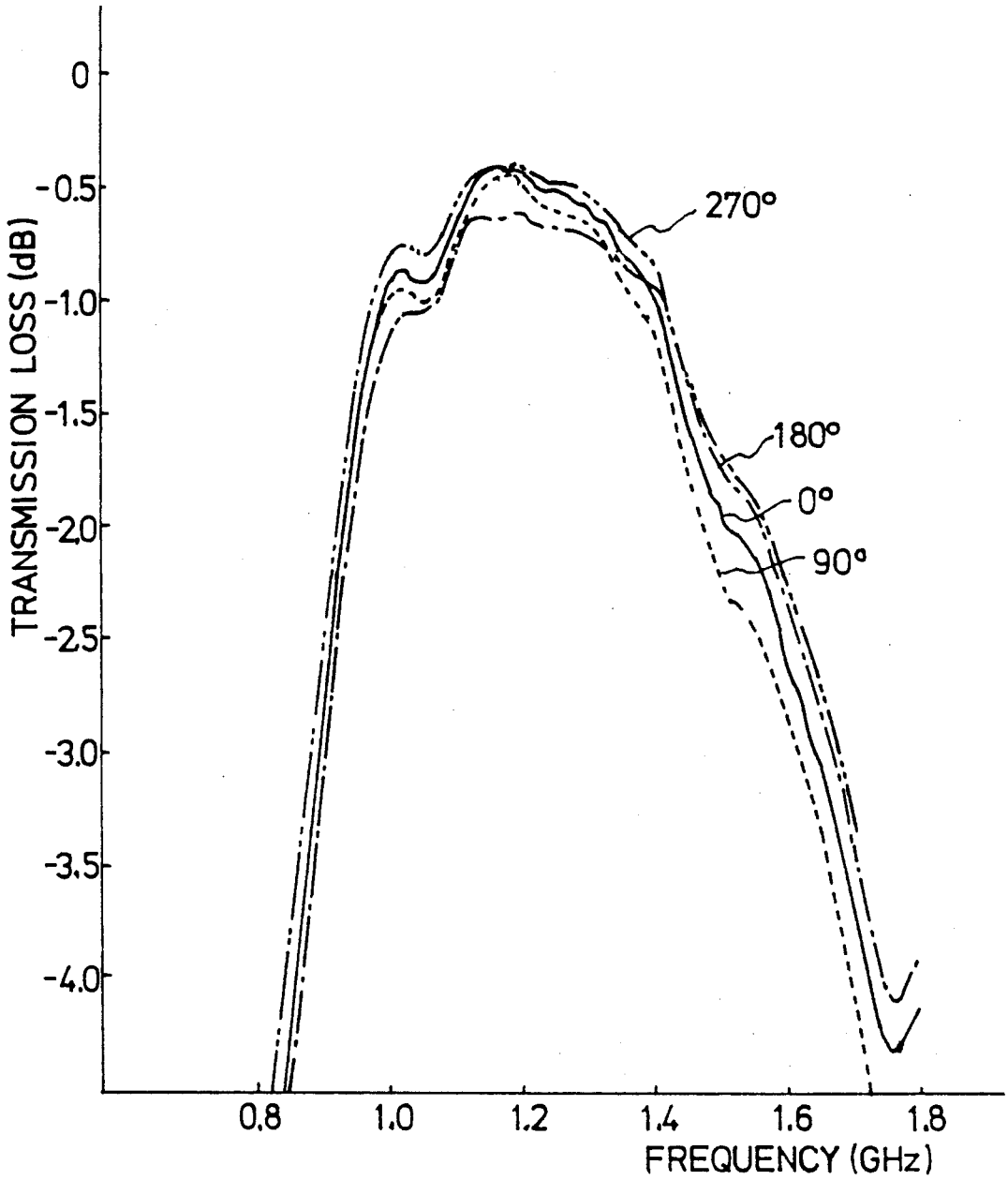
FIG. 7 is a diagram provided for comparing frequency characteristics of transmission loss for four positions of relative rotation of the rotary electrodes of FIG. 5.

FIG. 7 shows a relationship between transmission loss and frequency of a rotary high frequency repeater circuit formed as described above with respect to angles of relative rotation of the inductance elements 18a and 18b, in which zero degree corresponds to the position of FIG. 5A and 90 degrees correspond to the position of FIG. 5B. As understood from both drawings, the area of the superposed portion of both inductance elements 18a and 18b is substantially fixed regardless of the angle of relative rotation and there is little change in electric capacitance therebetween. However, there is some variation in the frequency characteristic caused by the angle of relative rotation because there is some change in the mutual inductive coupling M and distributed capacitance caused by the angle of relative rotation. As shown in FIG. 7, the value of transmission loss of this circuit is as low as about 0.3 dB to 1.0 dB over a wide frequency range of about 1.0 GHz to 1.4 GHz. This frequency range corresponds to the frequency range of satellite broadcast receiving systems. This frequency range of low transmission loss can be arbitrarily changed by adjusting the length and/or width of the inductance elements 18a and 18b.

Figure 8:
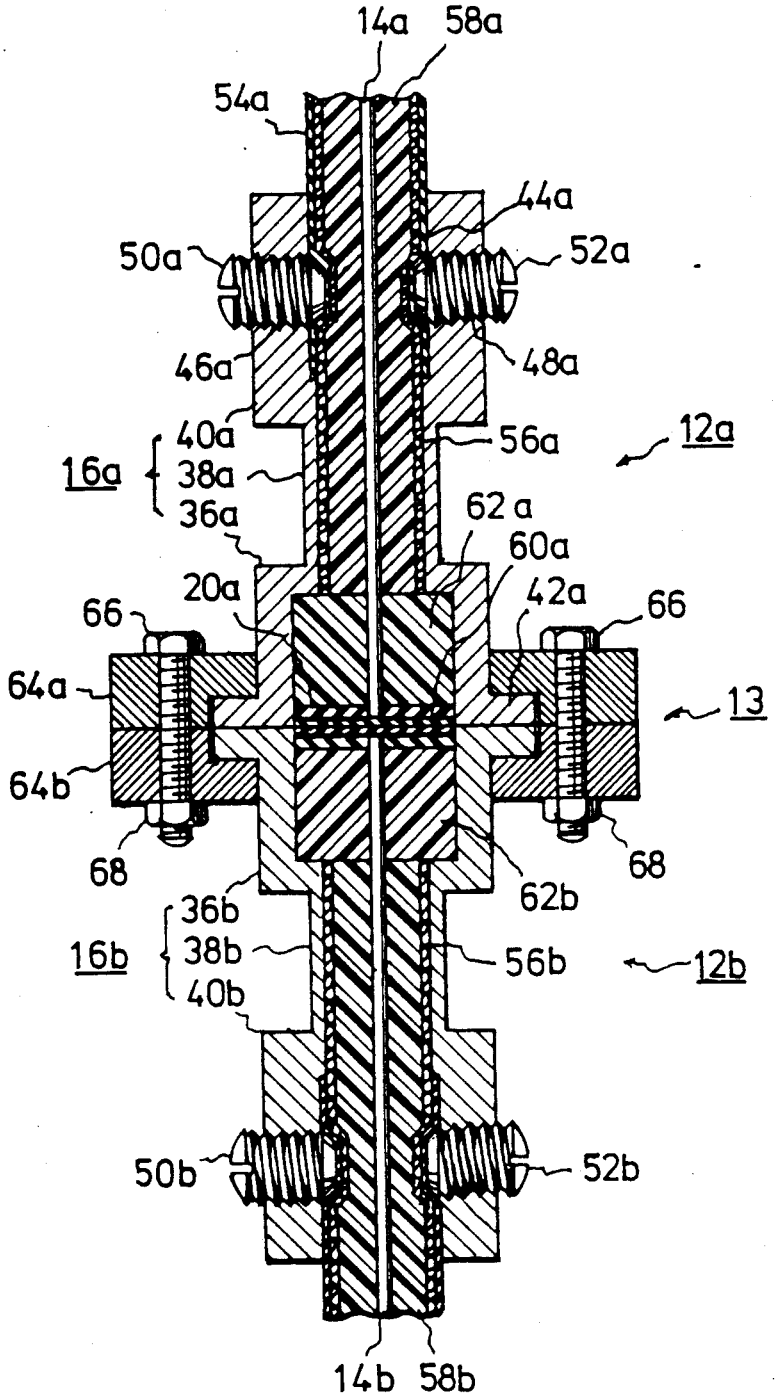
FIG. 8 is a longitudinal sectional view representing a structure of an embodiment of the device according to this invention.

FIG. 8 shows an embodiment in which the above-mentioned repeater circuit is realized as a high frequency coaxial line coupling device used for connecting a coaxial cable, from a convertor attached to a satellite broadcast receiving antenna which is carried on a moving body, to another coaxial cable connected to a satellite broadcast receiving tuner. This device includes a pair of connectors 12a and 12b and coupling means 13 for coupling them in relatively rotatable fashion. As the connectors 12a and 12b have the same structure and geometry as shown, their structural components will be referred to by the same numerals accompanied by suffixes "a" and "b". While the following description will be made only about the connector 12a, it should be noted that the same description can be applied also to the connector 12b. In order to avoid complexity, the reference numerals are removed from part of the structural components of the connector 12b in FIG. 8.

The connector 12a includes a shell 16a consisting of a cylindrical head portion 36a, a succeeding neck portion 38a having a smaller diameter and a thicker tail portion 40a. The head portion 36a has a cylindrical cavity open forward and a flange 42a is formed around the opening thereof. The cavity of the head portion 36a connects with a coaxial cable insert hole 44a which penetrates through both neck and tail portions 38a and 40a. The tail portion 40a has screw holes 46a and 48a in which tightening screws 50a and 52a are screwed, respectively. A coaxial cable 58a having the top portion of its coating 54a pealed to expose its braid 56a is inserted into the coaxial cable insert hole 44a and the braid 56a is put in contact with the inner wall of the insert hole 44a to attain electrical connection with the shell 16a. The tightening screws 50a and 52a press the coaxial cable 58a through its coating 54a to fix it.

The end of the core 14a of the coaxial cable 58a fits in a central hole of a circular printed board 20a which has a spiral conductor pattern 18a as shown in FIG. 4 (not shown in FIG. 8) formed on the front face thereof and electrically connected by its central portion to the core 14a. An insulating film 60a is formed on the front face of the printed board 20a to cover the conductor pattern 18a. The printed board 20a is positioned with respect to the shell 16a so that the front face of the insulating film 60a and the front face of the flange 42a lie on the same plane, and the cavity of the head portion 36a is filled with a dielectric material 62a such as plastic.

Figure 9:
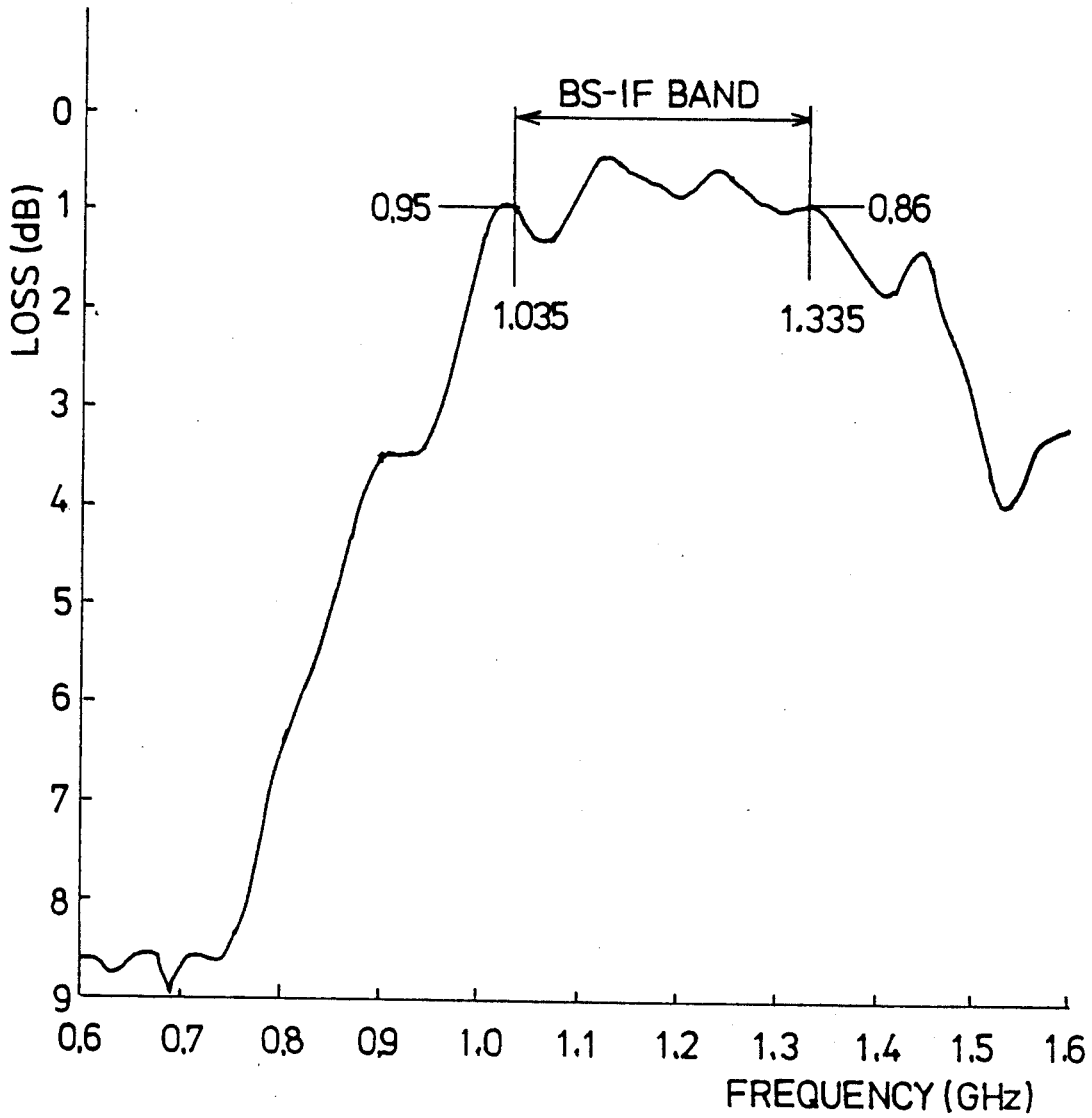
FIG. 9 is a diagram representing a frequency characteristic of transmission loss of the embodiment of FIG. 8.

As shown, the connectors 12a and 12b are mutually coupled by coupling means 13 in such a state as to have their front faces butting against each other. The coupling means 13 consists of a pair of annular members 64a and 64b fit around the flanges 42a and 42b of the shells 16a and 16b, and a plurality of bolts 66 and nuts 68 adapted to couple both members so as to allow mutual free rotation of the connectors 12a and 12b therebetween. With this structure, the conductor patterns 18a and 18b of both connectors 12a and 12b form a capacitor having the insulating films 60a and 60b as its dielectric and give the distributed capacitances 22 of FIG. 6, and a slight gap between the flanges 42a and 42b gives the stray capacitance 24. Accordingly, the structure of FIG. 8 forms a high frequency repeater circuit having the equivalent circuit of FIG. 6. FIG. 9 shows its frequency characteristic of transmission loss obtained by suitably selecting the geometry and spacing of the spiral patterns 18a and 18b, the material of the insulating films 60a and 60b and the like. It can be seen from the drawing that this device serves as a bandpass filter having as its pass band the frequency band from 1035 MHz to 1335 MHz of the first intermediate frequency signal which is transmitted from a satellite broadcast receiving converter to a corresponding tuner. Although the stray capacitance 24 raises the impedance, the characteristic of this filter can be improved by adjusting the reactance of the patterns 18a and 18b.

While the insulating films 60a and 60b serve as the dielectric between the conductor patterns 18a and 18b in the above embodiment, these films may be removed and the space between the conductor patterns 18a and 18b may be filled with air or silicon grease as the dielectric to form the capacitor which provides the distributed capacitances 22 and the stray capacitance 24.

Figure 10:
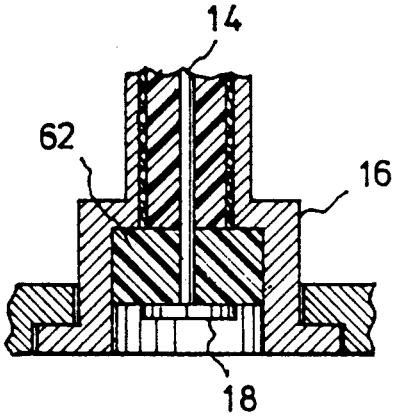
FIG. 10 is a longitudinal sectional view representing a partial variation of the embodiment of FIG. 8.
Figure 11:
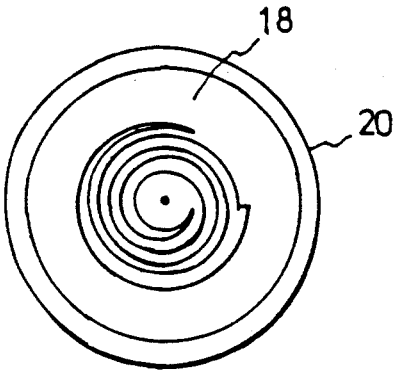
FIG. 11 is a plan view representing a variation of the shape of the rotary electrode of the device according to this invention.

While the spiral pattern 18 is formed on the printed board by etching in the above embodiment, it may be formed of a spiral winding 18 as shown in FIG. 10. FIG. 11 shows another shape of the spiral pattern 18 in which the central portion provides reactance and the peripheral portion provides a capacitor electrode.

The above embodiment has been given for illustrative purpose only and is not intended to limit the scope of the invention. It should be obvious to those skilled in the art that various modifications and changes can be made without leaving the spirit and scope of the invention as defined by the appended claims. For example, the geometry and structure of the coupling means belong to designer's option.

We claim:

1. A high frequency coaxial line coupling device comprising a pair of coaxial lines each including a signal line and reference potential means surrounding said signal line, characterized in that each of said signal lines is provided with a spiral electrode element having its central end connected to the top end of said signal line and spreading on a plane normal to said signal line, a pair of said electrode elements are adapted to face concentrically each other at a predetermined interval and to enable relative rotation about a common axis of said signal lines, and the directions of the spirals of said electrode elements are mutually opposite as viewed from either side of said signal lines.

2. A device as set forth in claim 1, characterized in that each said signal line is the central conductor of a coaxial cable, each said reference potential means is an electroconductive tubular member connected to the outer conductor of said coaxial cable and having a contact end face which is normal to said axis, said device further comprising coupling means for coupling said tubular members so as to have said contact end faces butting against each other and holding said members to allow relative rotation about a common axis, and electrode elements are arranged mutually parallel at a predetermined interval in a coupled state of said tubular members.

3. A device as set forth in claim 2, characterized in that each said spiral electrode element is composed of a electroconductive film formed on the surface of an insulating member.

4. A device as set forth in claim 2, characterized in that an internal cavity formed by said tubular member and said insulating member is filled with dielectric material.

5. A device as set forth in claim 1, characterized in that each said spiral element has an inductance.

* * * * *